US005762112A

United States Patent [19]

Feer

[11] Patent Number: 5,762,112

[45] Date of Patent: Jun. 9, 1998

[54] SHEDDING DEVICE HAVING PISTON-CYLINDER SYSTEM

[75] Inventor: Mark Feer, Winterthur, Switzerland

[73] Assignee: AGM Aktiengesellschaft Müller, Neuhausen, Switzerland

[21] Appl. No.: 701,402

[22] Filed: Aug. 22, 1996

[30] Foreign Application Priority Data

Aug. 30, 1995 [CH] Switzerland ..... 02 461/95

[51] Int. Cl.[6] ..... D03C 13/00; D03C 3/22

[52] U.S. Cl. ..... 139/456

[58] Field of Search ..... 139/456, 155; 66/204, 205

[56] References Cited

U.S. PATENT DOCUMENTS

| | | | |
|---|---|---|---|
| 3,853,150 | 12/1974 | Romano . | |
| 4,125,135 | 11/1978 | Ebisch | 139/456 |
| 5,360,038 | 11/1994 | Sano | 139/456 |
| 5,390,709 | 2/1995 | Martonffy | 139/456 |

FOREIGN PATENT DOCUMENTS

| | | |
|---|---|---|
| 0536899 | 4/1993 | European Pat. Off. . |
| 2832515 | 2/1979 | Germany . |
| 1482640 | 8/1977 | United Kingdom . |

*Primary Examiner*—Andy Falik

*Attorney, Agent, or Firm*—Spencer & Frank

[57] ABSTRACT

A shedding device for looms includes healds each having a first end and a second end; and a piston-cylinder system for guiding warps in the healds by moving the healds between a top shed position and a lower shed position. The piston cylinder system includes: pistons each being connected at one end thereof to the second end of a corresponding one of the healds; and cylinders, each piston being reciprocatingly disposed in a corresponding one of the cylinders. The device further includes a system block, the cylinders defining bores in the system block; a guide block defining guide bores therein, the first end of each of the healds being guided in the guide bores of the guide block; a regulating pressure arrangement for actuating the pistons within the cylinders alternatingly between the top shed position and the lower shed position, the regulating arrangement including an arrangement for producing a return force on the pistons thereby bringing respective ones of the healds to their lower shed position. The arrangement for producing includes: a feed line connecting the pressure medium source to the cylinders on an upper side of the pistons; and a valve arrangement disposed in the feed line. A guide bore cleaning system is provided for periodically cleaning the guide bores with pressure medium. The cleaning system includes a common feed line connecting a source of the pressure medium to the guide bores; and a valve arrangement disposed in the common feed line.

10 Claims, 3 Drawing Sheets

SHEDDING DEVICE HAVING PISTON-CYLINDER SYSTEM

FIELD OF THE INVENTION

The present invention relates to with which warps guided in healds are moved back and forth between a top shed position and a lower shed position.

BACKGROUND OF THE INVENTION

Relevant shedding apparatuses are, in addition to others, the so-called jacquard machines in which the healds are in operative connection with hooks movable over lifter knives, with the possibility being given to detach the engagement between lifter knife and hook and to reproduce the same in order to obtain a desired jacquard design. Commonly used for this purpose are needle arrangements which move the hook out of the path of movement of the lifter knives in accordance with pattern repeat control cards in a position where the hook and the associated lifter knife are out of engagement, so that during the next movement of the lifter knife it is moved past the hook which is thus controlled and does not entrain it. This process is called the reading in of a design or control according to design. In more modern machines this reading in no longer occurs mechanically, but electrically through electromagnets which deflect the hooks.

With the electric reading in or the electronic processing of the design data which is common here it was possible to considerably reduce the number of moved parts in the machine and thus to achieve a substantially higher working frequency of the electronic jacquard machine. But here too it is still necessary to move many parts such as magnetic means, hooks, lifter knives, healds with the warps and the like as well as the springs or weights of the pull-back apparatus. Particularly the mechanical pull-back apparatus for resetting the hooks with the actuating means acting thereon into the usually lower shed position prevents a further increase of the working frequency of the machine.

SUMMARY OF THE INVENTION

It is therefore the object of the present invention to achieve at first in existing arrangements of the kind mentioned above a return to the lower shed position following any desired high working frequency and in a further embodiment of the invention to provide a shedding device with electronic reading in of designs in which the control of the hooks can be omitted entirely.

The above object is achieved in accordance with the invention by providing a pneumatic or hydraulic piston-cylinder arrangement which acts on each heald.

Such a pull-back apparatus in a shedding device permits any desired working frequency, is practically free from any malfunctions and wear and tear, produces little noise and can be retrofitted without any problems in all kinds of shedding devices.

In a preferred embodiment of such a pull-back apparatus the piston-cylinder system can comprise pistons effective at the free end of each heald which are each reciprocatingly movable, with the pistons each resting rigidly on the free end of the heald or being intermediately connected with the latter via a piston rod. The cylinders can be small cylinder tubes which are cast in a block or parallel bores in a ceramic block. Moreover, the cylinders can be connected via feed lines to a source of a pressure medium, preferably compressed air, which charges the pistons with compressed air in order to produce on the same a return force in order to bring the healds to the lower shed position.

Furthermore, the present invention relates to a shedding device with electronic design read-in on the basis of the pull-back apparatus in accordance with the invention, in which the hook control can be omitted entirely.

This is achieved in accordance with the invention in such a way that the piston of each heald is under the influence of a regulating pressure of the pressure medium alternatingly in the direction of the top shed and lower shed position of the respective heald, with each heald being arranged as a piston rod exiting from the piston-cylinder system whose free ends are guided in a torsionally rigid manner in guide bores in a heald guide block which is distanced from the system block.

In the embodiment of such a shedding device, the guide bores can be in connection with a source for the pressure medium via a common feed line and valve means in order to allow periodically a cleaning by compressed air of the heald guide. Furthermore, the cylinders can be in a flow connection on the upper side of the pistons with the compressed air source via feed lines and valve means in order to produce a return force.

Moreover, the cylinders can each be in flow connection on the lower side with the compressed air source via control lines and via a multi-valve control unit or the like in order to press in a selected way the pistons and thus the healds with the warps into the top shed position. The design control can thus occur via a control device with a central computer system which controls the valve means and the multi-valve control unit according to the entered design data, with the design data being drawn up on a computer system and transferred by means of diskettes to the control device.

BRIEF DESCRIPTION OF THE DRAWINGS

Exemplary embodiments of the subject matter of the invention are explained below in closer detail by reference to the enclosed drawing, wherein.

DETAILED DESCRIPTION OF THE INVENTION

Figure 1:
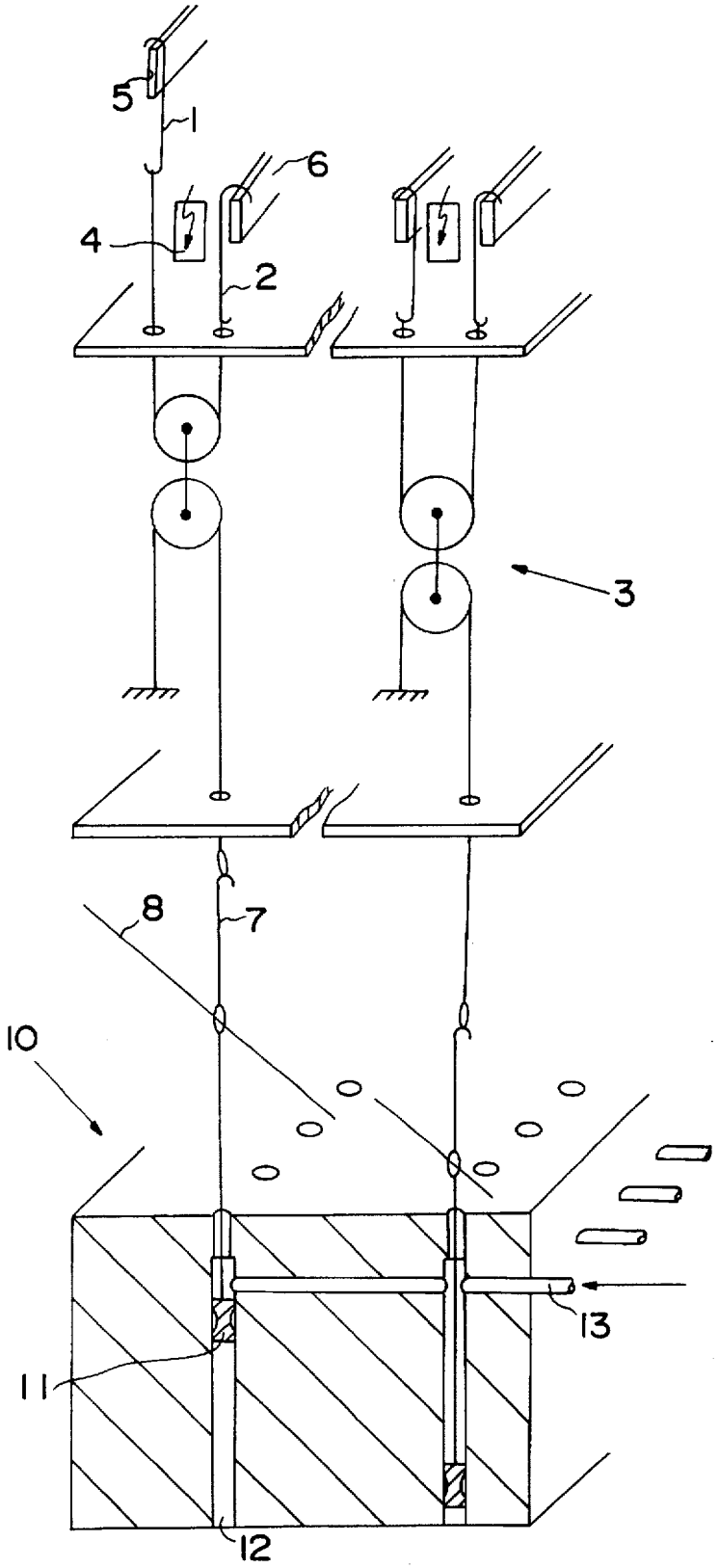
FIG. 1 shows a first embodiment of a shedding device for looms in accordance with the invention in a schematic, partly diagrammatic sectional view.

The shedding device for looms pursuant to FIG. 1 is a so-called open-shed jacquard machine, in which two hooks 1,2 are connected via a common pulley lifting tackle 3 at the lower end, with the hooks, depending on the control, being couplable here via magnetic means 4 with two continuously oppositely moved lifting knives 5, 6, as a result of which the heald 7 attached to pulley lifting tackle 3, and thus the warp 8, is subjected to a controlled stroke movement between the top shed position (left side of FIG. 1) and a lower shed position (right side).

To this extent such shedding devices for looms are generally known, with a large number of other systems existing here in order to reciprocate the healds with the warps for shedding.

The common feature in these known shedding devices is that for the respective return of the healds into the lower shed position a tension spring acts on each heald (not shown).

The important aspect of the invention is to replace the known mechanical pull-back apparatus, which consists of a plurality of tension springs corresponding to the number of healds, by a piston-cylinder system 10.

This piston-cylinder system 10 comprises pistons 11 effective at the free end of each heald, which pistons are each reciprocatable in a cylinder 12. The pistons 11 can either rest rigidly on the free end of the healds or be intermediately connected with the latter via a piston rod. The cylinders 12 can be small cylinder tubes cast in a block with an inner diameter of 2.8 to 3.5 mm for example or parallel bores in a ceramic block. The selection of material and method of construction are not subjected to any limitations.

The cylinders 12 are connected in the drawing at the top via feed lines 13 to a source of a pressure medium which is not designated in closer detail, preferably compressed air, which air charges the pistons 11 at a pressure of 4 bar for example in order to produce thereon a return force of up to 250 gr for example so as to bring the respective healds securely into the lower shed position. The lifting force to overcome the return pressure exerted by the compressed air on the piston 11 is then approx. 280 to 560 gr and is provided without any problems by the hook control.

In order to compensate for leakage flows, leakage sensors (not shown) can be provided for monitoring or reregulating the pressure, or the supplied pressure medium can be applied permanently with the same pressure level.

Such a described pull-back apparatus in a shedding device allows any working frequency, is practically free from any malfunctions and wear and tear, produces little noise and can be retrofitted without any problems in all kinds of shedding devices.

On the basis of the aforementioned pull-back apparatus it is further possible to provide a shedding device in which the still existing moved parts such as magnetic means, the hooks and the lifter knives, and furthermore the pulley lifting tackles, bottom boards, heald frame and others can be omitted, i.e. to provide a shedding device with electronic design read-in in which the hook control can be omitted entirely.

Figure 2:
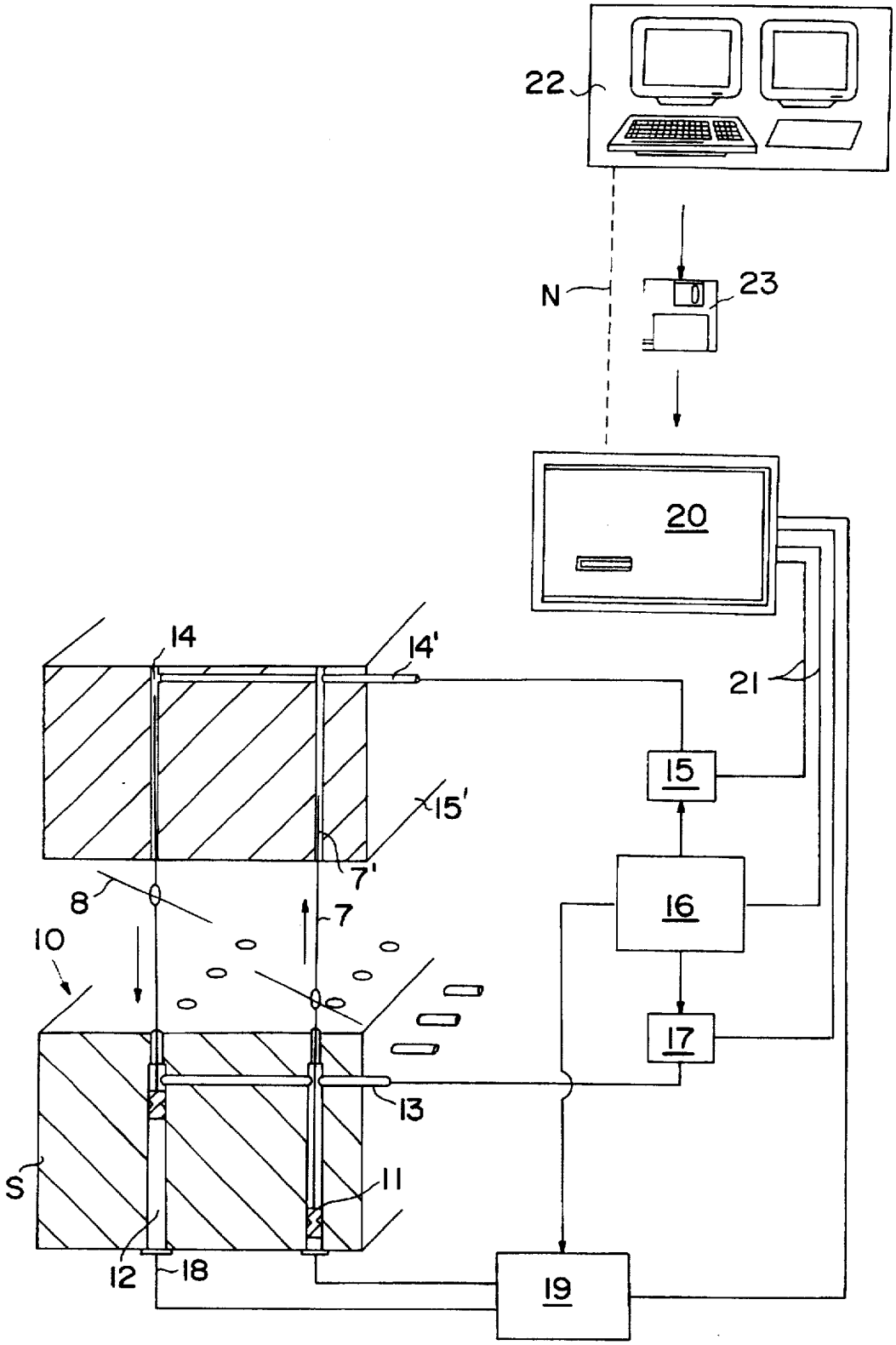
FIG. 2 shows a further embodiment of a shedding device for looms in accordance with the invention in a schematic, partly diagrammatic sectional view.

This is achieved in accordance with the invention as shown in FIG. 2 in that the piston 11 of each heald 7 is alternatingly in the direction of the top shed position and lower shed position of the respective heald under the influence of a regulating pressure of the pressure medium, with each heald 7 being arranged as a piston rod exiting from a piston-cylinder system 10 whose free ends 7' are guided in a torsion-proof manner in guide bores 14 in a heald guide block 15 distanced from the system block 15.

As a variant of an embodiment the healds can also be connected to the piston via additional piston-rod-like means.

The guide bores 14 are in flow connection with a source 16 for the pressure medium, usually compressed air, via a common feed line 14' and a valve means 15' in order to allow periodically the cleaning of the heald guide means by compressed air.

The cylinders 12 are in flow connection with the compressed air source 16 at the top side of pistons 11 via feed line 13 and valve means 17 in order to produce a return force, as was described above.

Furthermore, the cylinders 12 are each in flow connection with the compressed air source 16 on their lower side in the representation via control lines 18 and via a multi-valve control unit 19 or fluid control or a flow controller or the like in order to press, in a selective manner, the pistons 11 and thus the healds 7 with the warps 8 with 4 to 8 bar for example into the top shed position.

Optionally, a pressure below atmospheric could be produced alternatingly via the control lines 18 in order to produce a return force.

The design control occurs via a control device 20 with a central computer system which controls the valve means 15, 17 and the multi-valve control unit 19 via respective signal lines 21 in accordance with entered design data.

Such fluid controls per se are known and are suitable to operate piston-cylinder systems at high speed.

Figure 3:
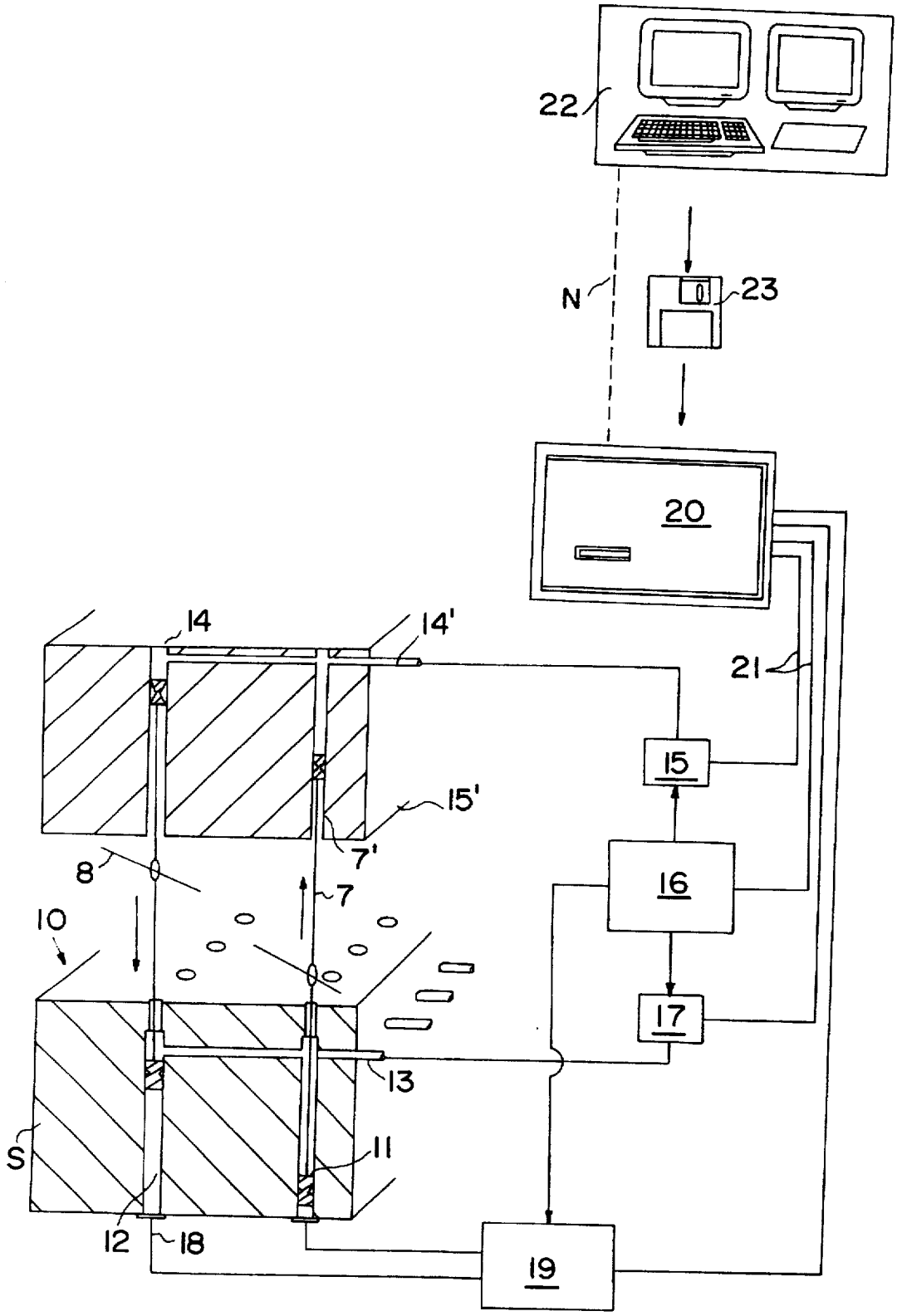
FIG. 3. shows a further embodiment of a shedding device similar to FIG. 2 where each heald of the loom is connected to a pair of pistons.

The control in the aforementioned sense can naturally also occur via the control line 13 in the opposite sense. Furthermore, it is also, as shown in FIG. 3, and within the scope of the invention to effect the control via a double piston system in an alternating manner.

The design data can be produced on a computer system 22 and transmitted by means of diskettes 23 to the control device 20.

It is also possible, for example, to transmit the completed designs into the control unit within the scope of a network of several machines from one central computer, whereupon the control device 20 of each machine will process the design data transmitted by way of networking arrangement N from the memory.

Such arrangements for electronic reading in of design data are also known per se and need not be explained herein in closer detail.

The relevant aspect is that the control of the healds and thus of the warps occurs directly through the piston-cylinder system and that as a result of this it is possible to omit the hook control entirely.

Accordingly, such a shedding device is suitable for any working frequency of the loom, and is thus practically free from any malfunctions and any wear and tear.

What is claimed is:

1. A shedding device for looms comprising:

a plurality of healds, each of the healds having a first end and a second end;

a piston-cylinder system operatively connected to the healds for guiding warps in the healds by moving the healds alternatingly between a top shed position and a lower shed position, the piston cylinder system being configured to act upon each heald and comprising:

a plurality of pistons, each of the pistons being connected at one end thereof to the second end of a corresponding one of the healds; and a plurality of cylinders, each of the pistons being reciprocatingly disposed in a corresponding one of the cylinders;

a system block, the cylinders defining bores in the system block;

a guide block disposed at a distance from the system block and defining guide bores therein, the first end of each of the healds being guided in the guide bores of the guide block;

a regulating pressure means operatively connected to the system block for actuating the pistons within the cylinders alternatingly between the top shed position and the lower shed position, the regulating pressure means including a means for producing a return force on the pistons thereby bringing respective ones of the healds to their lower shed position, the means for producing including:

a first feed line connecting the pressure medium source to the cylinders on an upper side of the pistons; and a first valve means disposed in the first feed line;

a pressure medium source;

a guide bore cleaning system for periodically cleaning the guide bores with pressure medium, the cleaning system including:

a second feed line connecting the pressure medium source to the guide bores; and a second valve means disposed in the common feed line.

2. The shedding device according to claim 1, wherein each of the pistons is adapted to be connected at the one end thereof directly to the second end of a corresponding one of the healds.

3. The shedding device according to claim 1, wherein the piston-cylinder system comprises a plurality of piston rods, each of the piston rods being connected, at one end thereof, to a corresponding one of the pistons, and being connected, at another end thereof, to a corresponding one of the healds.

4. The shedding device according to claim 1, wherein the cylinders comprise cylinder tubes cast in the system block.

5. The shedding device according to claim 1, wherein:

the system block is made of ceramic; and the cylinders comprise parallel bores in the system block.

6. The shedding device according to claim 1, wherein the source of pressure medium comprises a source of compressed air.

7. The shedding device according to claim 1, wherein the plurality of pistons comprises a plurality of pairs of pistons, each of the pairs of pistons being connected to a corresponding one of the healds.

8. The shedding device according to claim 1, wherein each of the healds comprises a piston rod projecting from the system block.

9. The shedding device according to claim 1, further comprising a means for selectively moving the pistons and thereby the healds, together with the warps, into the top shed position, the means for selectively pressing including:

a first feed line connecting the pressure medium source to the cylinders on a lower side of the pistons; and a multi-valve control unit disposed in the second feed line.

10. The shedding device according to claim 9, further comprising:

a design control device including a central computer system for controlling the first valve means, the multi-valve control unit and the second valve means in accordance with computer produced input design data, the design control device being operatively connected to the means for producing, the means for selectively moving and the guide bore cleaning system; and means operatively connected to the control device for transmitting the design data to the design control device, the means for transmitting comprising one of a diskette and a networking arrangement.

* * * * *